United States Patent [19]

Childs

[11] 4,434,740

[45] Mar. 6, 1984

[54] WIND-SCOOP FOR SMALL BOATS

[76] Inventor: John M. Childs, 13031 Deva St., Coral Gables, Fla. 33156

[21] Appl. No.: 491,802

[22] Filed: May 5, 1983

[51] Int. Cl.[3] ..... B63B 19/06; B63J 2/02

[52] U.S. Cl. ..... 114/211; 114/177

[58] Field of Search ..... 114/177, 178, 179, 180, 114/211, 212; 296/208, 91; 98/2.14, 9, 20, 78; 403/400; 135/102; 273/56

[56] References Cited

U.S. PATENT DOCUMENTS

| | | | |
|---|---|---|---|
| 2,562,103 | 7/1951 | Kline | 98/20 |
| 2,839,986 | 6/1958 | Herman | 114/211 |
| 3,364,840 | 1/1968 | Lipton | 114/211 |
| 3,757,664 | 9/1973 | Jalbert | 114/211 |

FOREIGN PATENT DOCUMENTS

| | | | |
|---|---|---|---|
| 273785 | 5/1930 | Italy | 114/177 |
| 18160 | 8/1903 | United Kingdom | 135/102 |

*Primary Examiner*—Trygve M. Blix
*Assistant Examiner*—Patrick W. Young
*Attorney, Agent, or Firm*—Ernest H. Schmidt

[57] ABSTRACT

A wind-scoop for small boats has a collapsible framework of resiliant bent wire members, over which a dome-shaped fabric cover member is received in form fitting relation, one side only of which cover member is air permeable for scooping wind to be directed below deck. The bent wire members of the framework, at their lower ends, are provided with radially outwardly-directed hook means for releasable attachment with respect to the peripheral edge of a deck through opening.

4 Claims, 6 Drawing Figures

WIND-SCOOP FOR SMALL BOATS

BACKGROUND OF THE INVENTION

This invention releates to wind-scoops, and is directed particularly to a combination wind-scoop and ventilator for use with pleasure boats, yachts and the like.

Various types of deck mounted wind-scoops or ventilators have heretofore been devised for use in marine vessels of all sizes for ventilating below deck areas. Such wind-scoops or ventilators are most often permanently installed, and include mechanism of one kind or another for air flow control and, especially in inclement weather, for water and air-tight sealing. Such wind-scoops or ventilators, while satisfactory for larger marine craft, and not suitable or paracticable, because of their complexity, size and cost, for use on motor craft and sailboats having small deck area and engine compartment and other below deck size.

It is, accordingly, the principal object of this invention to provide a novel and improved wind-scoop for small boats, particularly pleasure craft, that is compactly collapsible when not in use to provide for easy stowage, and which will be inexpensive to manufacture, and therefore low in cost.

A more particular object of this invention is to provide a collapsible wind-scoop of the character described which comprises a simple bent-wire frame that, when assembled serves not only to receive thereover a form-fitting flexible fabric cover, half of which is air permeable for scooping wind, but which also serves to releasably and adjustably secure the assemblage over a deck opening when in use.

Another object is to provide a wind-scoop of the character described which can readily be adjusted to ventilate either by scooping wind to below deck or by exhausting air by suction, depending upon the rotary positional adjustment of the device with respect to the prevailing winds during running conditions.

Other objects are to provide a wind-scoop of the above nature which will be simple in construction, easy to install and adjust, and durable in use.

Still other objects, features and advantages of the invention will be apparent from the following description when read with reference to the accompanying drawings.

DESCRIPTION OF THE PREFERRED EMBODIMENT

Figure 1:
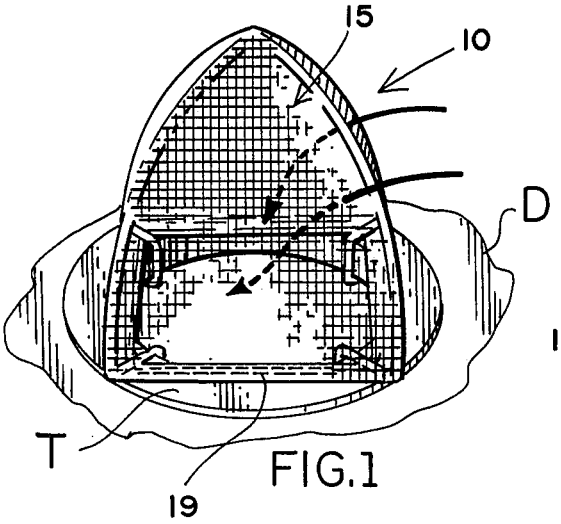
FIG. 1 is an oblique view, as seen from above, of a wind-scoop embodying the invention, shown installed in a boat deck.

Referring now in detail to the drawings, reference numeral 10 in FIG. 1 illustrates, by way of example, a preferred form of wind-scoop embodying the invention, shown installed in a boat deck D (partially illustrated). The wind-scoop 10 comprises a bent wire frame 11 (see FIG. 6). The wire frame 11 is symmetrical about its longitudinal axis and comprises crossed, resilient wire members 12, 13 detachably secured together as by mating detents or clips at their apices, as indicated at 14, to define, when assembled, a dome or bell-shaped figure upon and about which a cover member 15 fits, as is hereinbelow described. Where fitted together at their apices, the crossed wire members 12, 13 are preferably arcuately reversely bent for slightly in excess of 180 circular degrees to interhook by detent action at their juncture.

Figure 6:
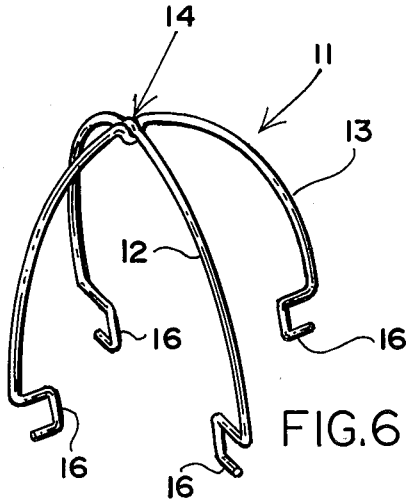
FIG. 6 is a perspective view, seen from above, of the resiliant framework of the wind-scoop illustrated in FIGS. 1 through 5.

As further illustrated in FIG. 6, the outer or depending ends of the frame wire members are inwardly, downwardly and outwardly bent to provide rectangular hook portions 16 adapted to interhookingly engage with peripheral marginal edge portions of a boat deck opening, as is hereinbelow more particularly described.

Figure 2:
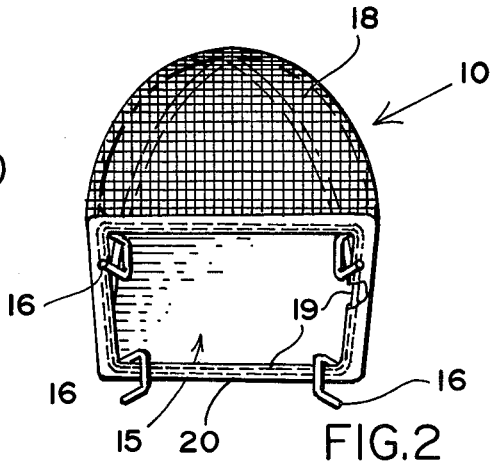
FIG. 2 is a separate oblique view, as seen from underneath, of the wind-scoop.
Figure 3:
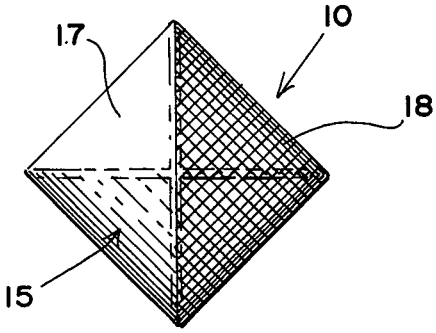
FIG. 3 is a top view of the wind-scoop.
Figure 4:
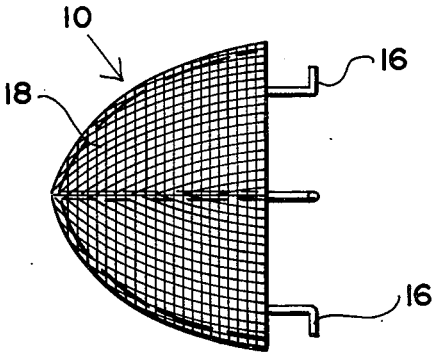
FIG. 4 is a projected side view of the screen side of the wind-scoop illustrated in FIG. 3.
Figure 5:
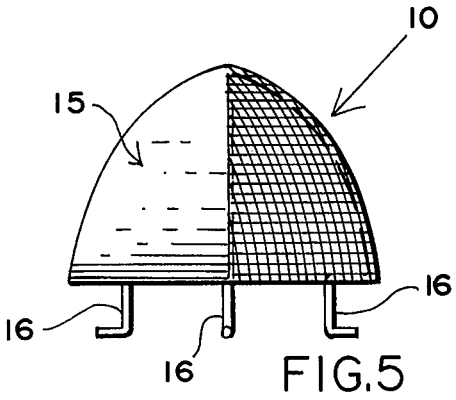
FIG. 5 is a side elevational view of the wind-scoop illustrated in FIG. 3.

The cover member 15 is divided into two half sections 17, 18, section 17 of which is not wind permeable, such as being a tight-woven fabric of Nylon, and section 18 of which is screen mesh or screen material, also of Nylon or another weather resistant synethetic plastic material such as fiber-glass. The cover member half sections 17 and 18 are sewn together, and are of such size, shape and arrangement as to be form-fitting over the bent wire frame 11, as is best illustrated in FIGS. 3 and 4. The cover member is preferably removably secured in place with use of an elastic cord 19 within a hollow beading or hem-like trim 20 sewn along the peripheral opening of said cover member (see FIG. 2).

In use, the wind-scoop 10 can readily be applied to a boat deck opening of suitable size simply by compressing the sides of the cross-wire members 12, 13 to enable their hook portions 16 to pass through the deck opening, and then releasing to allow said members to interhookingly engage marginal edge portions of the opening.

As illustrated in FIG. 1, the opening of deck D may be provided with a circular trim ring T with respect to which the wind-scoop 10 is interhookingly engaged. The trim ring T will preferably be part of a deck plate, the cover of which can be replaced when the wind-scoop is not being used. It will be understood that the wind-scoop could be applied to a boat deck opening of any suitable size, whether of round, square or other polygonal shape, without departing from the invention. It is also to be understood that the hook portions 16 of the cross-wire members 12, 13 can readily be bent to accommodate to different thicknesses of boat deck openings.

Depending upon how the wind-scoop is positioned in its deck opening, it can serve principally either to force air below deck, or as a device for exhausting air, depending upon the running conditions of the boat and ambient weather conditions. Thus, when the wind-scoop is positioned so that the screened portion 18 faces windward, air will be scooped in and forcefully directed below deck, whereas if the screened section is directed leeward, the vacuum or suction created serves forcefully to exhaust air from below deck.

While I have illustrated and described herewith only one from in which my invention can conveniently be embodied in practice, it will be understood that this embodiment is presented by way of example only and not in a limiting sense. For example, although the bent wire frame 11 is illustrated and described as having only two crossed resiliant wire members, three or four resiliant wire members could be interfitted at their apices to provide a hexagonal or octagonal frame for the support of a correspondingly shaped cover member. My invention, in brief, comprises all the embodiments and modifications within the scope and spirit of the following claims:

What I claim as new and desire to secure by Letters Patent is:

1. A collapsible wind-scoop for releasable attachment over a through opening in the deck of a small boat comprising, in combination, a resilient framework of symmetrical dome-shaped configuration, said framework having an apex at the upper end thereof and a base portion at the lower end thereof, a flexible cover member shaped to fit over and confirm with said resilient framework, between said upper and lower ends thereof, one half-section of said cover member defined by a plane including the axis of symmetry of said resilient framework and being not air permeable and the other half-section being air permeable, and means at the lower end of said dome-shaped framework for releasable attachment with respect to marginal edge portions of a boat deck opening, said resilient framework comprising a pair of bent wire members substantially symmetrical about an axis of generation and crossing at their apices, and means for releasably inter-securing said bent wire members at their apices, said releasable attachment means comprising radially outwardly open hook portions bent in the ends of said wire members.

2. A collapsible wind-scoop as defined in claim 1, wherein said means for releasably inter-securing said bent wire members at their apices comprises a pair of complementary, reversely-bent, arcuate recesses of slightly greater than 180 circular degree extent at the apices of one each of said bent wire members to provide an inter-connecting detent.

3. A collapsible wind-scoop as defined in claim 2, including means at the open end of said flexible cover member for removable securement with respect to said framework.

4. A collapsible wind-scoop as defined in claim 3, wherein said cover member securement means comprises an elastic band surrounding the peripheral opening of said cover member.

* * * * *